United States Patent [19]

Schaefer

[11] 4,347,007

[45] Aug. 31, 1982

[54] TYPEWRITER CARTRIDGE AND FEED MECHANISM THEREFOR

[75] Inventor: John O. Schaefer, Lexington, Ky.

[73] Assignee: International Business Machines Corporation, Armonk, N.Y.

[21] Appl. No.: 801,286

[22] Filed: May 27, 1977

[51] Int. Cl.[3] ..... B41J 35/28

[52] U.S. Cl. ..... 400/208; 400/213.1; 400/206.1; 400/228; 400/229; 400/697.1

[58] Field of Search ..... 197/151, 168, 181

[56] References Cited

U.S. PATENT DOCUMENTS

| | | | |
|---|---|---|---|
| 2,165,739 | 7/1939 | Verkinderen | 197/151 UX |
| 3,171,530 | 3/1965 | O'Daniel et al. | 197/151 |
| 3,346,090 | 10/1967 | Goff et al. | 197/151 X |
| 3,348,650 | 10/1967 | Meinherz et al. | 197/151 |
| 3,349,888 | 10/1967 | Page | 197/151 X |
| 3,432,020 | 3/1969 | Caudill et al. | 197/151 |
| 3,513,957 | 5/1970 | Ricciardi et al. | 197/151 |
| 3,528,626 | 9/1970 | Bumb | 197/151 X |
| 3,643,779 | 2/1972 | Anderson et al. | 197/151 |
| 3,724,633 | 4/1973 | Korb et al. | 197/151 |
| 3,731,781 | 5/1973 | Caudill et al. | 197/151 |
| 3,863,749 | 2/1975 | Perry et al. | 197/151 |
| 3,899,065 | 8/1975 | Brignole | 197/151 |
| 3,904,016 | 9/1975 | Hengelhaupt | 197/151 |
| 3,904,017 | 9/1975 | Frechette | 197/151 |
| 3,905,465 | 9/1975 | Frechette et al. | 197/181 |
| 3,985,219 | 10/1976 | Hurley | 197/151 |
| 3,995,731 | 12/1976 | Miller et al. | 197/168 |
| 4,010,839 | 3/1977 | Guerrini et al. | 197/151 |
| 4,013,160 | 3/1977 | Colecchi et al. | 197/151 |

FOREIGN PATENT DOCUMENTS

| | | | |
|---|---|---|---|
| 2108742 | 9/1972 | Fed. Rep. of Germany | 197/151 |
| 2306836 | 11/1976 | France | 197/151 |

OTHER PUBLICATIONS

Xerox Disclosure Journal, "Ribbon Cartridge With Foam Drag Element", Trezise et al., vol. 1, No. 2, Feb. 1976, pp. 47–48.

Xerox Disclosure Journal, "Constant Ribbon Tension Device", Frechette, vol. 1, No. 7, Jul. 1976, p. 37.

*Primary Examiner*—Ernest T. Wright, Jr.

*Attorney, Agent, or Firm*—William J. Dick

[57] ABSTRACT

Disclosed is a cartridge and a cartridge assembly for a typewriter, the assembly comprising a pair of case members, each case having a separate chamber and including means for releasably connecting the two cases in superimposed overlapping relation. First and second pairs of spaced apart ribbon guide means are associated with each of the cases and dimensioned to be aligned, first pair to second pair. Each of the case members includes a separate supply and take-up spool, the supply spool having a fixed axis of rotation and the take-up spool having a shiftable axis of rotation along a translatory path. An opening is provided along one edge of each of the cases, the openings being aligned in the paths while the take-up spools are biased in their respective paths towards the opening. Also disclosed is a drive mechanism for the cartridge in which the type of ribbon (for example, carbon or cloth) is indicated on the cartridge by a cam arrangement and, upon insertion into the machine, automatically selects the correct feed and ribbon lift mechanism to minimize ribbon wastage.

18 Claims, 21 Drawing Figures

FIG. 5
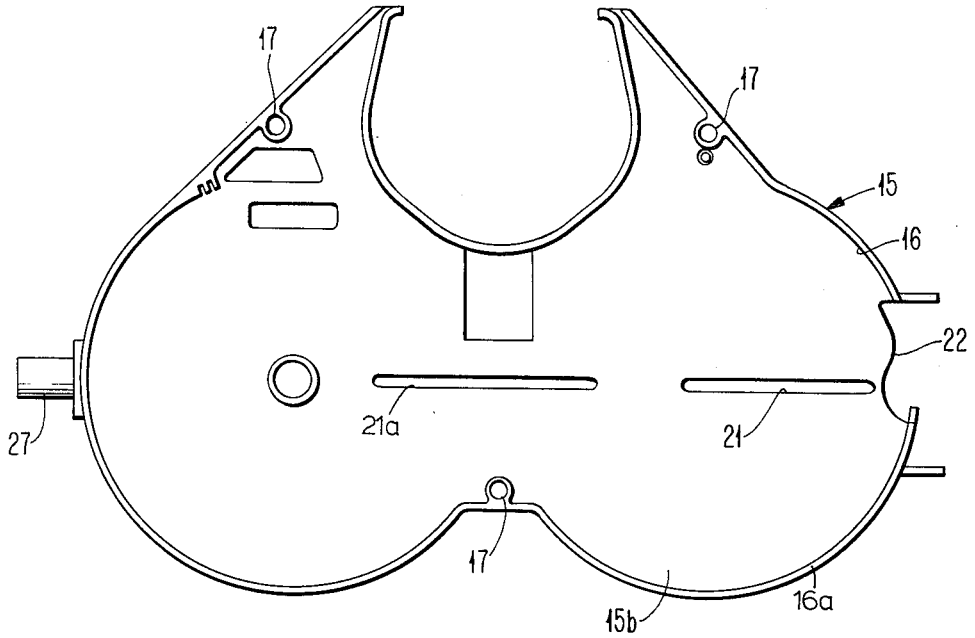
FIG. 4
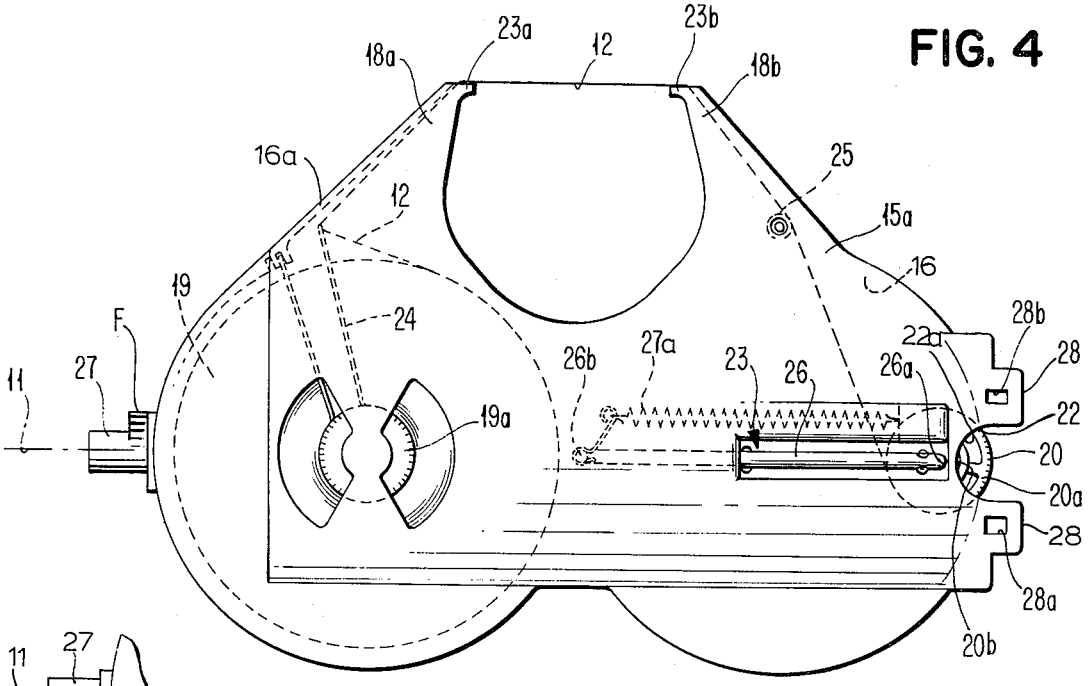
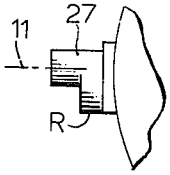
FIG. 4a

FIG. 7
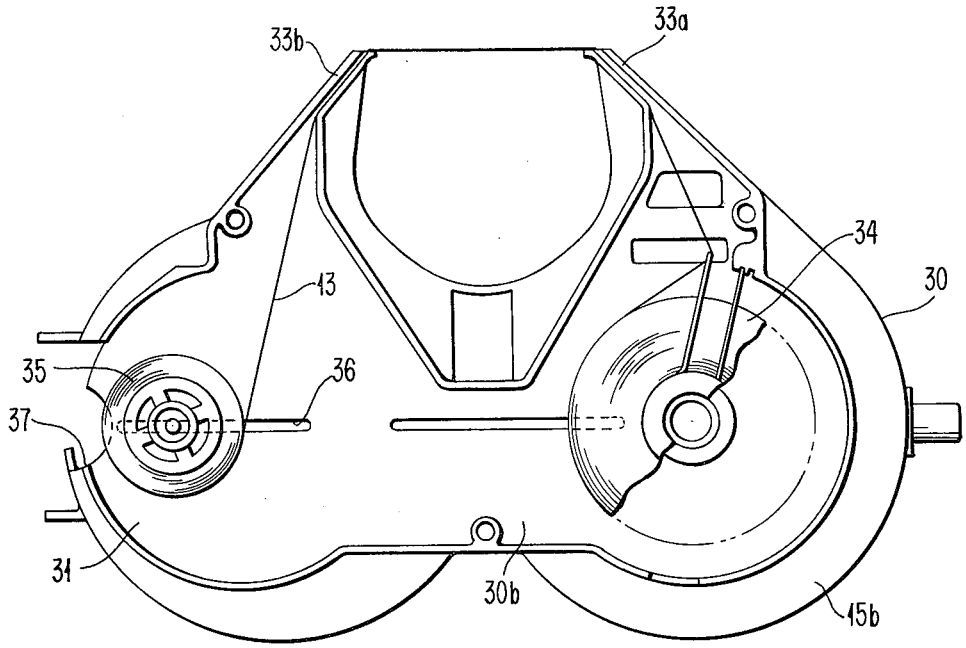
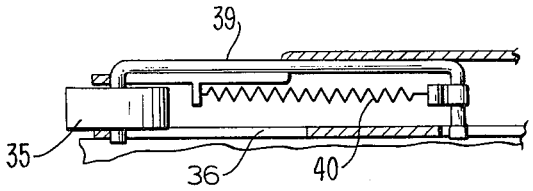
FIG. 8
FIG. 6
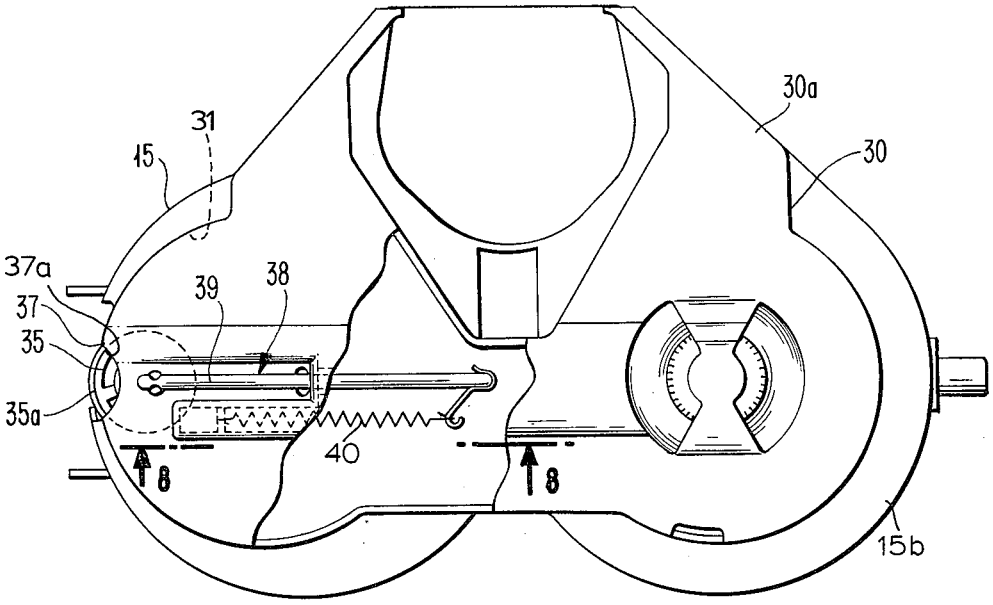

FIG. 12
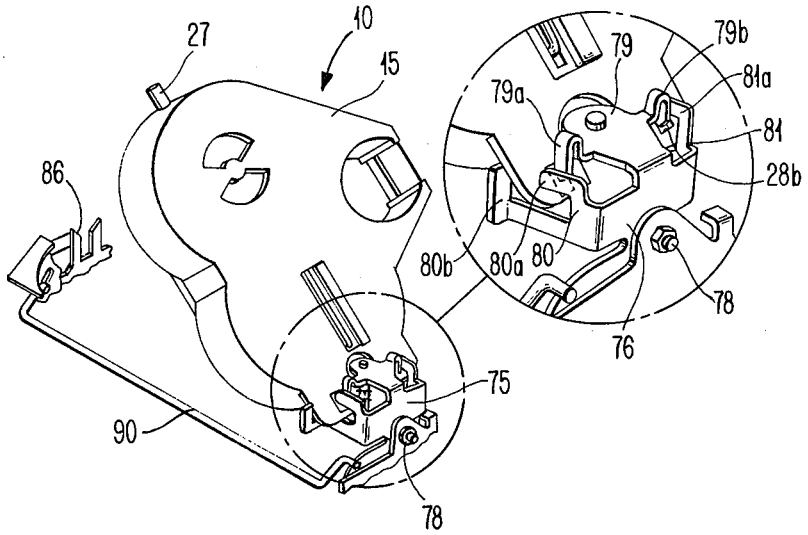
FIG. 13
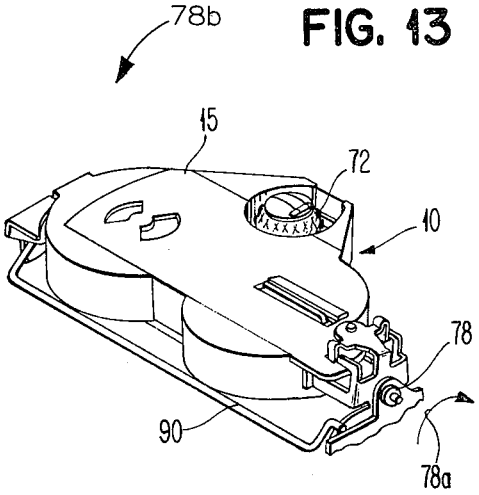
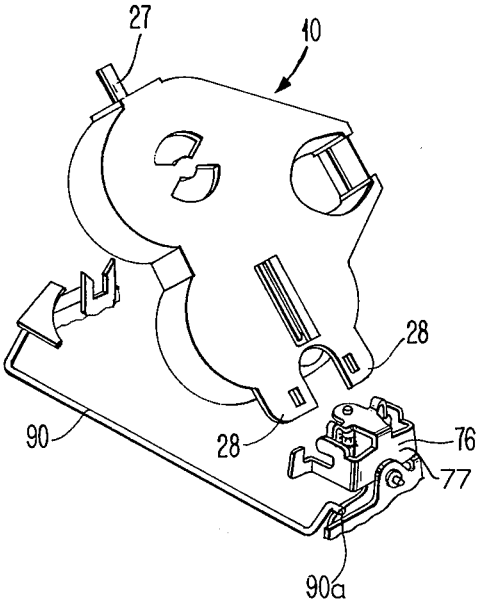
FIG. 11

NOTE: FEED $\frac{1}{2}$ BEFORE PRINT AND $\frac{1}{2}$ AFTER PRINT

TYPEWRITER CARTRIDGE AND FEED MECHANISM THEREFOR

FIELD OF THE INVENTION AND STATE OF THE PRIOR ART

The present invention relates to a cartridge for a typewriter and the feed mechanism for the ribbon held thereby, and more particularly relates to a cartridge assembly in which, for example, two ribbons such as a carbon or film ribbon may be employed in conjunction with an erase ribbon in separate and severable housings or cases in the assembly, and which may be separately and selectively driven by the novel drive mechanism which is shiftable automatically as to both ribbon feed rate and ribbon lift by action of the cartridge employed.

In conventional typewriters, for example such as the IBM Selectric typewriter, typing ribbon is wound in a case or cartridge on a supply spool, ribbon passes out an exit port and enough slack is left in the ribbon so that the typist, upon mounting the cartridge in the typewriter, handles the ribbon when placing the ribbon on the oscillating guides which form part of the typewriter mechanism. The tape or ribbon feeds back into the cartridge and onto a take-up spool, the take-up spool conventionally having a portion thereof which engages drive mechanism fixedly mounted on the typewriter. If the ribbon is of a carbon type, a special lift-off tape is employed such as disclosed in U.S. Pat. No. 3,788,442 issued on Jan. 29, 1974 and mounted on a separate feed mechanism. The typist in a similar manner, must thread the lift-off tape through the separate guides. When the operator is typing, the ribbon is lifted by the oscillating guides intermediate the single element typing head and the platen so that the typing element strikes the ribbon and prints upon the paper held by the platen. If the ribbon is carbon, the guides lift the ribbon to permit striking the ribbon at successive typing operations at different elevations of the ribbon, the ribbon being incrementally fed by the feed mechanism so as to take full advantage of the tape width while preventing overstrike of the single element printing element or ball against the ribbon. Intermediate each imprinting operation, the guides return the ribbon to a depressed position so that the typist may see the letter previously typed. Thus the mechanism takes full advantage of the width of the ribbon without overstrike while permitting the employment of a separate spool of tape for lift-off type operation.

Where it is not essential that the type be as perfect as a carbon ribbon can make, a "strikeover" type ribbon such as the "IBM Tech III" may be employed, the cartridge having means thereon for shifting the mechanism to permit strike-over merely by changing the ribbon feed rate. With this type of ribbon, the erase ribbon is conventionally of the cover up type as opposed to a lift-off type ribbon employed conventionally with carbon ribbon. In each instance, the ribbons must be handled by the typist for initial threading into the guides and then, when the cartridge has been used, the ribbon removed from the guides, leaving smudges at least on the operator's fingertips and many times on adjacent portions of the machine. One of the major reasons for bringing the ribbon externally of the cartridge which necessitates mounting or threading the ribbon through the oscillating guides (erase or print ribbon) is that the mass being moved, i.e., of the ribbon, is small. Moreover, in this type of machine, the loading of the cartridge is always a two-handed operation.

In view of the above, it is a principle object to the present invention to provide a novel cartridge and cartridge assembly for a typewriter which is easily insertable by the operator; does not require the operator to soil his/her hands in either removing or inserting the cartridge; and does not require ribbon slack removal.

Another object of the present invention is to provide a novel cartridge for a typewriter which is insertable within the typewriter with one hand by the operator and which engages in locking engagement therein in a position ready for immediate typing operations.

Still another object of the present invention is to provide a cartridge for a typewriter which will permit an automatic changing of the typewriter mechanism to accommodate the drive requirements of a plurality of ribbon types.

Yet another object of the present invention is to provide a novel cartridge assembly comprised of two sections, a first section containing the print ribbon, and the second section containing an erase ribbon or tape which is detachably coupled to the first case so as to form an assembly.

Still another object of the present invention is to provide easily actuable means on the cartridge assembly for coupling the assembly to the typewriter in locking engagement therewith and positioning the same after such coupling occurs automatically in a print position.

Yet another object of the present invention is to provide a novel cartridge for a typewriter in which the drive for the ribbon is positioned externally of the cartridge whereby upon insertion of the cartridge into the typing mechanism, the drive is coupled to the cartridge for motion therewith and yet externally of the cartridge.

Yet another object of the present invention is to provide a novel drive mechanism which cooperates with the cartridge of the present invention to permit rotation of the cartridge in a predetermined manner about a transverse axis of the cartridge so as to permit full usage of the width of the cartridge ribbon depending upon the type of ribbon employed in the cartridge.

Another object of the present invention is to provide novel drive mechanism for the cartridge which will permit a predetermined elevation of the cartridge about a transverse axis for presenting the ribbon to a printing element, and after printing occurs depress the cartridge about said axis to permit viewing by the operator of the previous print, and to automatically advance the ribbon intermediate at least predetermined print operations.

Yet another object of the present invention is to provide a simple yet effective drive mechanism for the novel cartridge assembly of the present invention which will effect both tape elevation and advance and permit selective operation automatically of the erase ribbon when desired by the operator.

Other objects and a more complete understanding of the invention may be had by referring to the following specification and claims taken in conjunction with the accompanying drawing in which:

IN THE DRAWING

Figure 1:
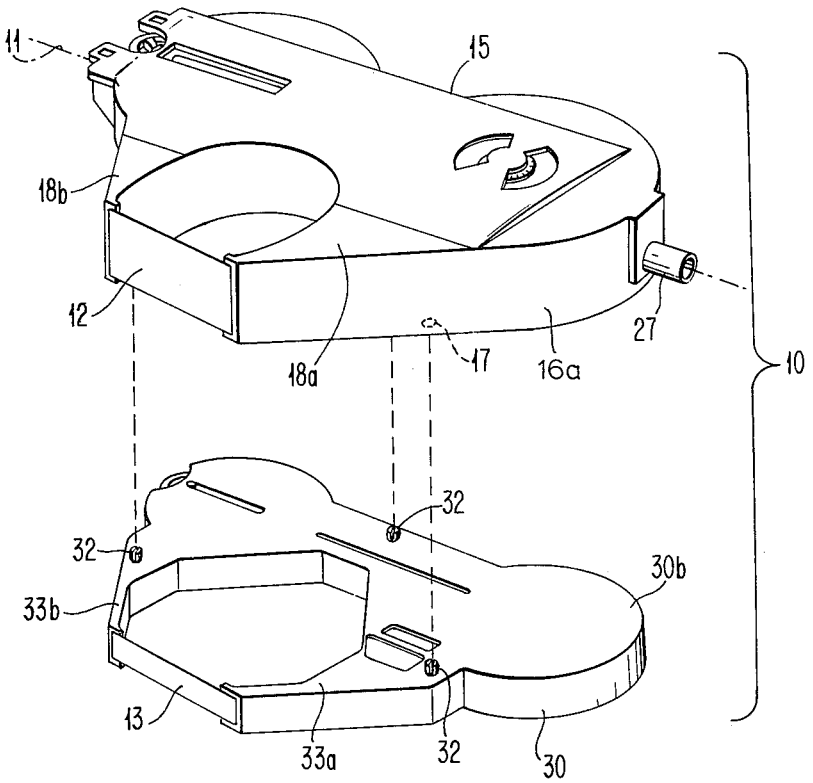
FIG. 1 is an exploded perspective view of a cartridge assembly comprised of cartridges constructed in accordance with the present invention.
Figure 2:
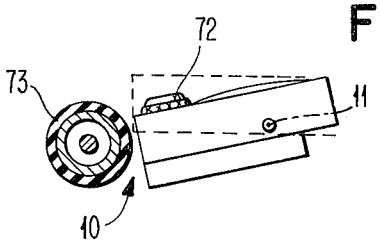
FIG. 2 is a schematic side elevational view of the cartridge assembly in position on a typewriter and illustrating the movement of the cartridge assembly relative to the print head and the platen.
Figure 3A:
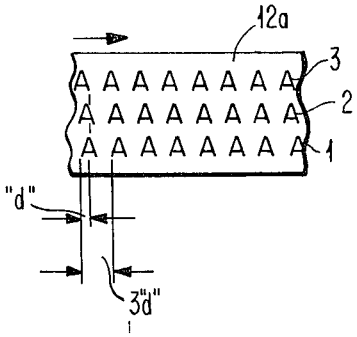
Figure 3B:
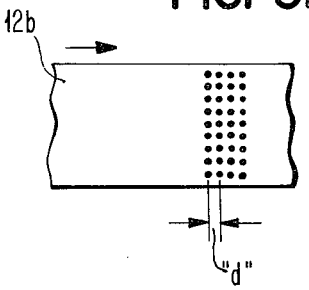
Figure 9:
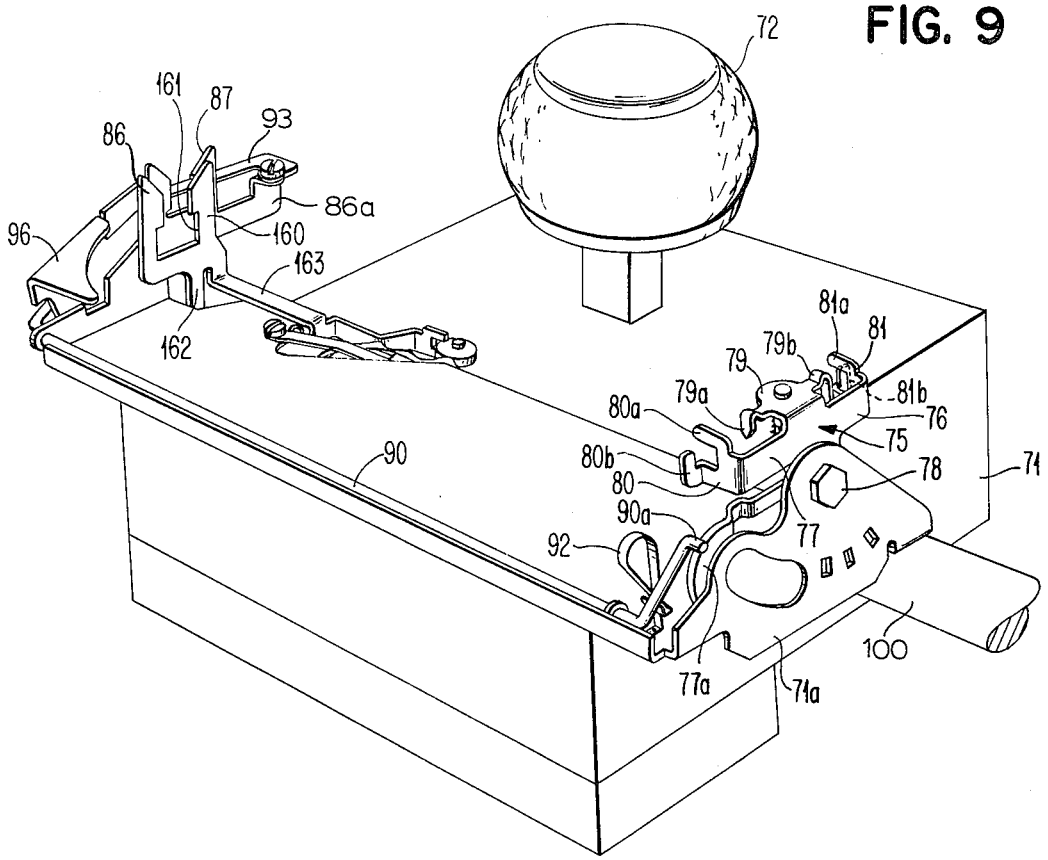
Figure 10:
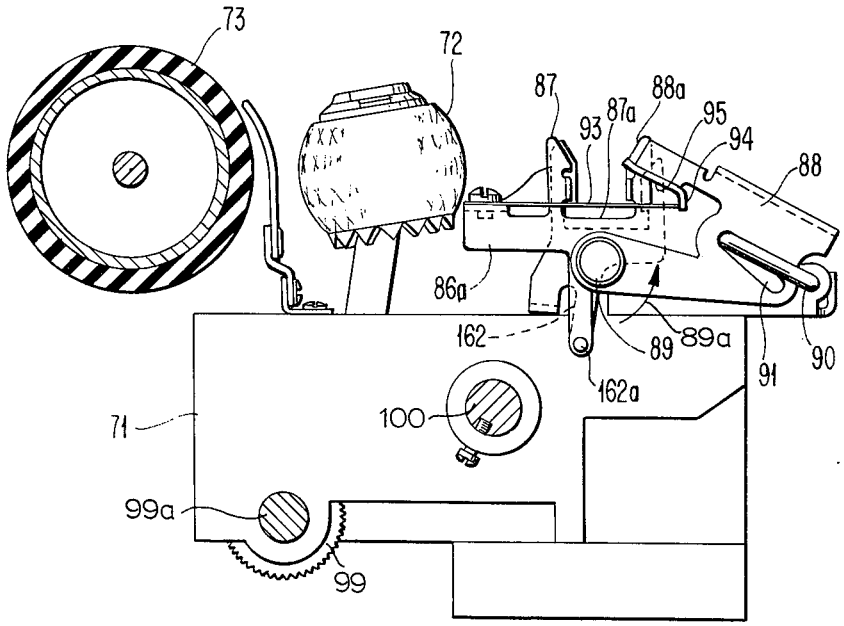
Figure 14:
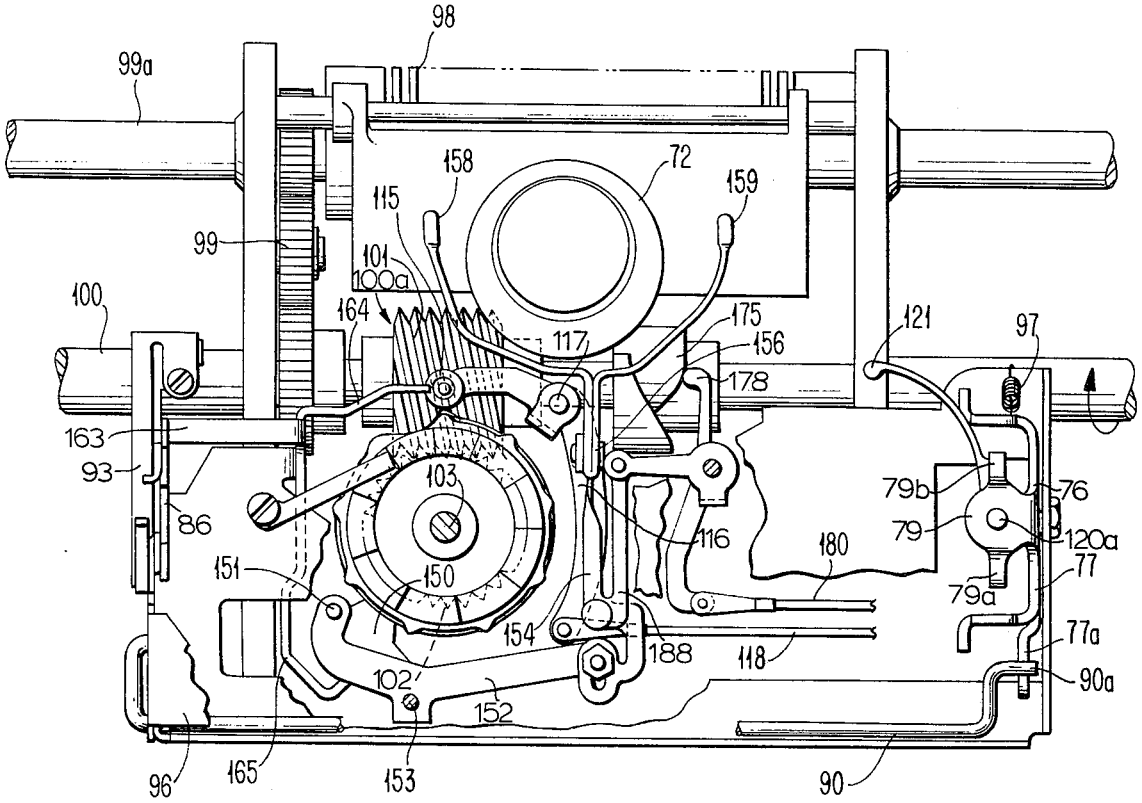
Figure 15:
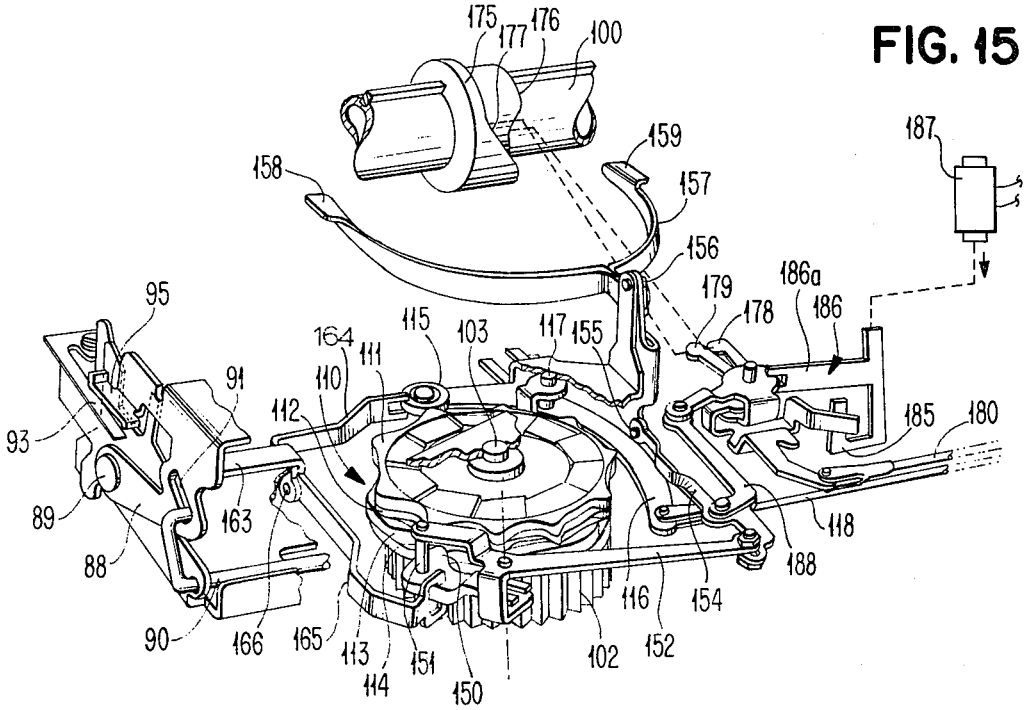
Figure 16:
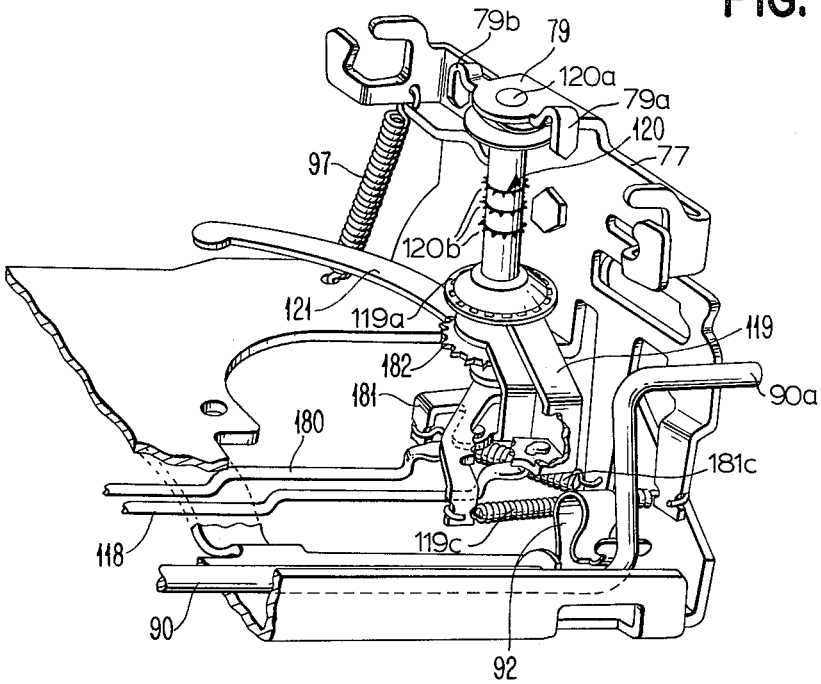
Figure 17:
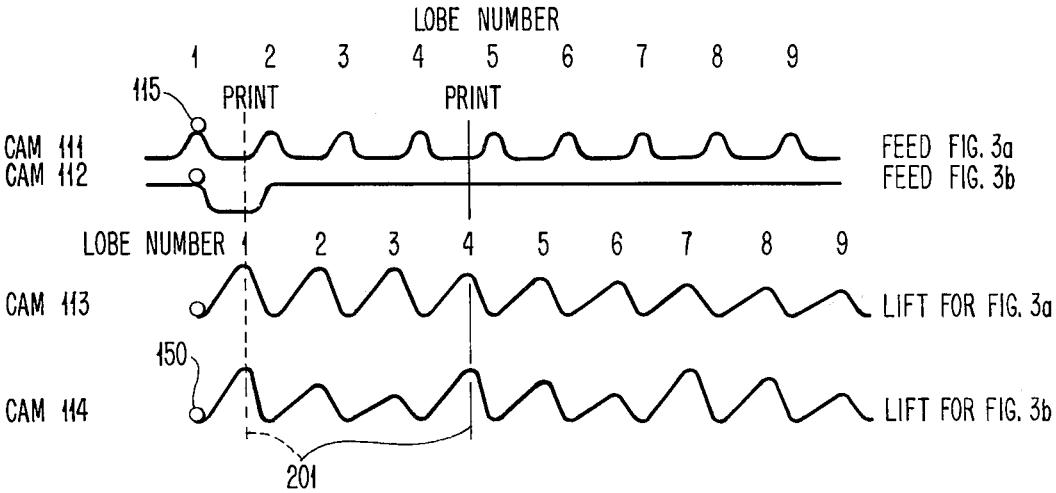
Figure 18:
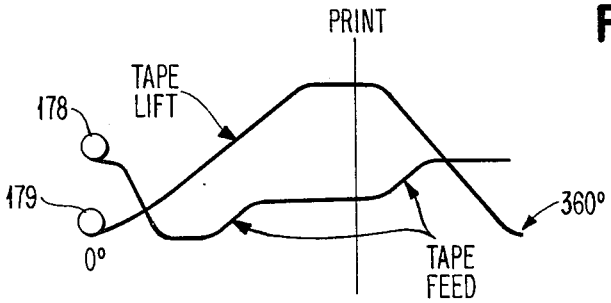

FIG. 3*a* is an enlarged fragmentary view of a portion of the print ribbon when the print ribbon employed is a carbon type;

FIG. 3*b* is an enlarged fragmentary view of another ribbon in wich strikeover is permitted and illustrating the spacing and tracks for elevation between letters or characters being typed by the typing head and cartridge illustrated in FIGS. 1 and 2;

FIG. 4 is a plan view of a cartridge constructed in accordance with the present invention, one of which is illustrated in FIG. 1;

FIG. 4*a* is a scrap view illustrating an alternate cam position for cartridges having a different ribbon;

FIG. 5 is a plan view of the cartridge illustrated in FIG. 4 with the top cover removed;

FIG. 6 is a fragmentary bottom view of the lower cartridge in the cartridge assembly illustrated in FIG. 1;

FIG. 7 is a bottom view of the cartridge illustrated in FIG. 6 but with the bottom cover removed;

FIG. 8 is a fragmentary sectional view taken along line 8—8 of FIG. 6;

FIG. 9 is a schematic perspective view of a portion of the mechanism adapted to accommodate the cartridge of the present invention;

FIG. 10 is a fragmentary sectional side elevational view of a portion of the apparatus illustrated in FIG. 9;

FIGS. 11, 12 and 13 are fragmentary perspective schematic views illustrating the manner in which the cartridge assembly of the present invention may be inserted into the novel drive mechanism for the cartridge;

FIG. 14 is a fragmentary plan view of a portion of the apparatus illustrated in FIGS. 9–13 for providing drive for the ribbon;

FIG. 15 is a fragmentary perspective view illustrating the relationship between certain parts of the novel drive mechanism for the cartridge;

FIG. 16 is a fragmentary perspective view of a portion of the mechanism illustrated in FIG. 14 which facilitates the feed of the ribbon associated with the cartridge assembly;

FIG. 17 is a cam timing diagram which illustrates both the ribbon feed and ribbon lift cam patterns for the cam illustrated in FIG. 15;

FIG. 18 is a layout of the erase function cam for both feed and lift; and

Figure 19:
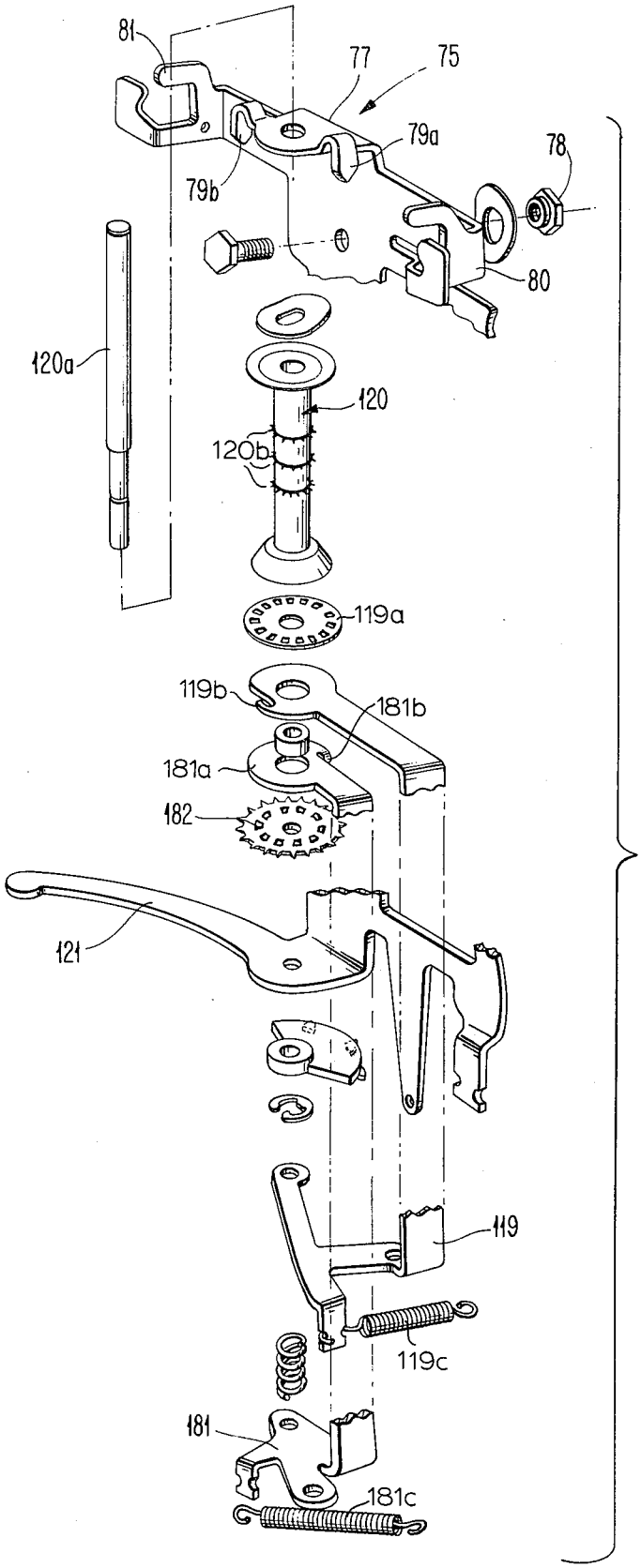

FIG. 19 is a fragmentary exploded perspective view of a portion of the apparatus illustrated in FIG. 16 by which the ribbon is fed for both ribbons of the cartridge assembly.

Referring now to the drawing and especially FIG. 1 thereof, a cartridge assembly 10 constructed in accordance with the present invention is illustrated therein. The assembly 10 comprises a first cartridge or case member 15 and a second cartridge or case member 30, each case member 15, 30 as shown in FIGS. 4, 5, 6 and 7 including a separate chamber 16, 31 and means (apertures 17 and snap pins 32) for releasably connecting the case members 15, 30 in superimposed overlapping relation. As illustrated in FIGS. 1 and 4–7, first and second pairs of spaced apart guide means 18*a*, 18*b*, 33*a*, 33*b* are dimensioned to be aligned, first pair to second pair. Separate ribbon supply and take-up spools 19, 20 and 34, 35 are mounted in the chambers 16 and 31 respectively, the supply spools 19 and 34 having a fixed axis of rotation and the take-up spools or rollers 20 and 35 having a shiftable axis of rotation along a path defined by slots 21 and 36 respectively. Means 22 and 37 define an opening 22*a* and 37*a* respectively along one edge of each of the case members 15 and 30, the openings 22*a* and 37*a* being aligned in the paths defined by slots 21, 36 respectively with each of the cartridge or case members 15, 30 including means 23, 38 to bias each of the take-up spools 20, 35 in their respective paths towards the openings 22*a* and 37*a*. The biasing action of the means 23, 38 also tends to bias the spools 20, 35 against the means 22 and 37 respectively, maintaining the ribbon 12 and erase tape or the like 13 in a taut condition within their respective cartridges. As will become more clear hereinafter, in use on a typewriter, ribbon and tape drivers operate on the take-up spools 20, 35 and move the spools 20, 35 away from the means 22 and 37 respectively thereby releaving the taut condition of the ribbon 12 and tape 13.

The cartridge assembly 10 may be inserted into the carrier portion 71 of a single element typewriter (for example) such is illustrated in FIGS. 2, 9 and 10, the carrier and selection mechanism for the single typing element being substantially that which has been disclosed in U.S. Pat. No. 3,892,304 issued on July 1, 1975, and in co-pending patent application Ser. No. 756,308 filed on Jan. 3, 1977, by Redding et al, owned by the assignee of the present application and hereby incorporated by reference.

The carrier portion 71, as described in the foregoing U.S. Pat. No. 3,892,304 and co-pending application Ser. No. 756,308, includes selection mechanism (not shown herein) for a typing element 72 (sometimes referred to as a ball) which is rotated and moved forward to strike a ribbon 12 and make an imprint of a selected letter against a sheet of paper held by the platen 73. Conventionally, and as has been explained heretofore in the statement of prior art, the ribbon is held by guides and moved upwardly into the path intermediate the moving typing element 72 and the platen 73, and then depressed between each striking of a key of the typewriter so that the operator may see where the typing element 72 is striking and thereby insure that the proper letter is being imprinted on the paper carried by the platen 73. In the present instance, the cartridge assembly 10 is locked into place in a cartridge holder 75 which will be more fully explained hereinafter, and the cartridge assembly 10 presents to the typing element 72 the ribbon 12 as by its guide means 18*a* and 18*b* (see FIG. 1), the space between the guide means 18*a* and 18*b* being sufficient to permit entry and exit of the typing element 72 from therebetween. Suffice at this time that upon clamping of the cartridge assembly 10 in the holder 75, no further action need be taken by the operator to prepare the machine for typing other than turning the switch on and providing paper etc. to the platen 73.

Depending upon the type of cartridge 15 presented and held by the holder 75, drive means 100*a* (FIGS. 14 and 15) operatively associated with the holder 75 effect rotation of the cartridge assembly 10 about an axis 11 so as to present different portions of the ribbon 12 during each typing operation to the typing element 72. Additionally, the drive means 100*a* not only provides for elevation of the ribbon 12 but effects advancement or feed of the ribbon 12 between the supply and take-up spools 19 and 20 so as to present new ribbon portions to the typing element 72 as typing commences.

As will become clear hereinafter, the motion of the cartridge 15 or the cartridge assembly 10 about the axis 11 is depicted best in FIG. 2. Depending whether the ribbon 12 is for example, a carbon ribbon 12*a*, or a ribbon 12 such as the IBM Tech III ribbon 126, will determine the coding provided by the cartridge assembly 10 which will in turn effect shifting of a portion of the drive means 100*a* associated with the holder 75 causing the lift and feed evidenced in FIG. 3*a* or the lift and feed shown in FIG. 3*b*. For example, if the ribbon 12 is a carbon ribbon 12*a* illustrated in FIG. 3*a*, where no strike-over is permitted, the motion of the cartridge assembly 10 will be to elevate the ribbon 12*a* to a first level 1, a character is printed ("A" in the drawing), the cartridge 15 or cartridge assembly 10 is then depressed and the ribbon 12*a* advanced in the direction of the arrow a distance d, the cartridge 15 or cartridge assembly 10 is then elevated to permit printing at a second level 2, and then depressed once again to permit the operator to view the letter or other indicia typed, and then advanced once again a distance d. The cartridge 15 or cartridge assembly 10 is then elevated to a third level 3 whereupon third indicia will be typed and then once again lowered or depressed and the ribbon 12*a* advanced another increment d. It is evident, therefore, that the distance between adjacent indicia in a single horizontal row on the ribbon 12*a* will be equal to 3*d*. In a like manner, if the ribbon 12*b* being used is, for example, a fabric ribbon wherein strike-over is permitted and useful to minimize ribbon waste and to permit maximum usage of the ribbon 12*b*, 9 imprints will occur for each incremental advancement, for example d advancement of the print ribbon 12*b* in the direction of the arrow. From the foregoing, it is obvious that the distance incrementally advanced by the elevation of the ribbon 12 to present the same at the print point is a matter of drive design. Moreover, it should be understood that if the difference in both elevation and feed of the print ribbon 12 is going to depend upon the type of print ribbon 12 utilized, if it is desired that such change be automatic, the obvious place to place the switch function or identifying print ribbon function is on the cartridge itself so that it automatically compensates or shifts for the required alternation of the print ribbon and feed of the same.

SPECIFIC CARTRIDGE EMBODIMENT

As has been previously explained, the cartridge assembly 10 comprises a pair of cartridges 15 and 30 respectively, the cartridge 15 being adapted to present to the typing element 72 printing ribbon 12 while the cartridge 30 has a more limited role or use of presenting to the typing element 72 an erase tape or the like 13. Although the cartridge assembly 10 may comprise a single unit, because the supply of printing ribbon 12 will normally be consummed or used before the correction ribbon or tape 13, it is believed desirable that the cartridges 15 and 30 be separable and yet matable in superimposed overlapping relation as briefly described heretofore. However, the principle cartridge 15 of the present invention may be utilized without the cartridge 30, while the converse is not true.

Referring now to the drawing, and especially FIGS. 1, 4 and 5 thereof, the cartridge 15 comprises a case member having an upper surface 15*a* and a lower surface 15*b* which mate with and are spaced apart as by the external case wall 16*a* thereby forming the chamber 16. At the end of the guide means 18*a*, 18*b* are respectively located the print ribbon 12 exit and entrance ports 23*a*, 23*b* respectively which allow the print ribbon 12 to traverse a path externally of the case member or cartridge 15 so as to be exposed to the typing element 72 for a printing operation. As shown best in FIG. 4, the supply spool 19 includes a hub 19*a* which is mounted in the upper and lower surface 15*a* and 15*b* for rotation. A drag wire 24 serves to maintain tension on the ribbon 12 being extracted from the supply spool 19 and is more fully described in IBM Technical Disclosure Bulletin, Vol. 18, No. 4, September 1975, page 1093 in an article entitled "Ribbon Drag Wire". The ribbon 12 exits through the exit port 23*a* and enters into the entry port 23*b*, past a guide pin or the like 25 and then is wound on the takeup spool 20, the spool 20 having a print ribbon advancing surface 20*a* thereon which cooperates with the opening 22*a* for exposing the print ribbon advancing surface 20*a* externally of the case member 15.

In order to insure that the print ribbon advancing surface 20*a* extends externally of the case member 15 so as to permit effective engagement thereof with the ribbon advancing or drive means (FIG. 16), the center 20*b* of the spool 20 is engaged by a shaft or rod 26 forming part of the biasing means 23, one end 26*a* of the rod 26 extending downwardly through the center 20*b* of the spool 20 and engaging the slot 21 in the lower surface 15*b* of the case member or cartridge 15. The opposite end 26*b* of the shaft 26 engages a spring 27*a* which is connected to the upper surface 15*a* of the case member 15 thereby serving to bias the rod 26 and thus the spool 20 towards the opening 22*a*.

Additionally, the depending or terminal end 26*b* of the rod 26 not only is guided in slot 21*a* but also serves to limit leftward depression along the axis of slots 21 and 21*a* because of engagement of the depending portion 26*b* with the peripheral winding of the supply spool 19.

Inasmuch as the cartridge 15 and associated mechanism was designed to minimize ribbon handling by the operator when loading and unloading the cartridge 15, it is necessary that the case member or cartridge 15 include a laterally extending axis of rotation, as illustrated in FIG. 1 the axis 11 which is approximately along the center of mass of the cartridge 15. A trunion 27 projects from the case member 15 along the axis 11 and clamping means formed in part as hinge means or projecting ears 28 on the case member 15 are spaced from the trunion 27 along the axis 11 permitting locking engagement in the holder 75 in conjunction with the trunion 27 so as to allow rotation of the cartridge 15 or the cartridge assembly 10 about the axis 11. In a manner which will be more fully explained hereinafter, the clamping means 28 serve as hinges and cooperate with a portion of the holder 75 (FIGS. 9 and 10) to clamp the cartridge 15 or the cartridge assembly 10 to the carrier 71 of the typewriter.

The cartridge or case member 30, in the illustrated instance loaded with erase tape 13, is identical to the cartridge 15 except for the lack of the separate clamping means 28 and trunion 27 associated with the cartridge 15. As may be seen in FIGS. 6, 7 and 8, the cartridge 30 is similar in all other respects to the cartridge 15, and includes a top (lower) cover 30*a* and lower bottom cover 30*b*, the bottom cover 30*b* adapted for mating engagement with the lower surface 15*b* of the cartridge 15 by way of the pins 32 and apertures 17. As may easily be seen in FIG. 6 and 7, the cartridge 30 is slightly smaller in overall configuration while the opening 37*a* is adapted to be mated with the opening 22*a* in the cartridge 15 when the cartridges 15 and 30 are in registry in superimposed overlapping relation. Additionally, take-up spool 35 includes, like its counterpart take-up spool 20, a ribbon advancing surface 35*a* which is exposed to the drive means which will be described hereinafter. Additionally, the spool 35 and thus its advancing surface 35*a* is biased as by the biasing means 38 which includes spring loaded rod 39 and spring 40, in identical fashion to that incorporated in the cartridge 15.

Drive and Holder Mechanism

As has already been described heretofore, the holder 75 (FIGS. 9 and 10) is adapted to receive the cartridge assembly 10 or at least the cartridge 15 and place it into position relative to the typing element 72 on the carrier 71 to facilitate typing. To this end, the holder 75 includes a first end 76 which cooperates with the clamping means 28 associated with the cartridge 15 or cartridge assembly 10 to clamp the one end of the cartridge assembly 10 along the laterally extending axis 11, and a second end 86 which cooperates with the trunion 27 of the cartridge 15 to releasably capture the trunion 27 and effect, when necessary, shifting of the drive mechanism depending upon the type ribbon 12 carried by the cartridge 15. The first end portion 76 of the cartridge holder 75 comprises a bracket 77 which is mounted for rotation about a stud or pivot 78 mounted on a sub frame 71*a* of the carrier 71. The bracket 77 includes a central portion 79 which projects inwardly of the carrier 71 and includes depending hinge pins or portions 79*a*, 79*b*, outboard of the central portion 79, and dimensioned to fit into the apertures 28*a* and 28*b* respectively associated with the hinge means or ears 28 projecting from the cartridge 15 (see FIG. 4). Outboard of the central portion 79 and its associated depending hinge pin 79*a*, 79*b* are in turn bifurcated, spaced apart clamp legs 80 and 81 respectively, each of the legs 80, 81 having vertically spaced apart projecting finger portions 80*a*, 80*b*, 81*a*, 81*b* which serve to embrace the projecting ears 28 of the cover hinge portion to serve as a clamp and cam forcing the pins 79*a* and 79*b* into locking engagement with the respective apertures 28*a*, 28*b* on the cartridge 15 upon insertion of the cartridge 15 into the typewriter.

The manner in which the cartridge assembly 10 is inserted into the holder 75 and first end 76 is clearly illustrated in FIGS. 11 through 13 wherein the cartridge 15 in FIG. 11 is shown being inserted pressing the hinge ears 28 towards the bracket 77. Insertion of the ears 28 into the bifurcated legs 80 and 81 assist in aligning the apertures or hinge openings 28*a* and 28*b* with the hinge pins 79*a*, 79*b* respectively so that after entry of the cartridge 15 or the cartridge assembly 10, the cartridge 15 or the cartridge assembly 10 may be depressed as shown by the arrow 78*b* in FIG. 13 permitting full engagement of the hinge pin 79*a*, 79*b* into the apertures 28*a*, 28*b* and due to the embracing lever or cam like action of the bifurcated legs 80 and 81, effect capturing of the cartridge assembly 10 in the holder 75.

Obviously, while the mechanism heretofore described would be adequate to locate and anchor one end of the cartridge assembly 10 or cartridge 15 relative to the typing element 72, it is preferable that the opposite end of the cartridge 15 be connected also to the second end 86 of the holder 75. To this end, and has already been described the cartridge 15 includes a trunion 27 which may be latched by the second end 86 so as to effect retention of the cartridge 15 while permitting rotation of the cartridge assembly 10 about the later or longitudinally extending axis 11 which passes through the cartridge 15 intermediate the hinge pins 79*a*, 79*b* and the associated hinge projections or ears 28 on the cartridge 15. To this end, and referring to FIGS. 9 through 13, the second end 86 includes a fixed, upstanding post or guide 87 which is attached to a bracket 86*a* connected to the carrier 71. Separately operable means comprising a shiftable bracket section 88 and a cover plate or piece 95 serves to capture the trunion 27 to limit its radial movement while permitting rotational movement thereof. The shiftable bracket section 88 is pivotally mounted as at 89 and biased to rotate about the pivot 89 in the direction of the arrow 89*a*, that is counterclockwise, as by the rod 90 and slot 91 arrangement in the bracket section 88 and spring 92 which bears against the rod 90 tending to create the rotation of the bracket section 88. The bracket section 88 is inhibited from such counterclockwise motion by a latch spring 93 adjacent the post or guide 87 and positioned slightly higher than the opening 87*a* defined intermediate the edge 88*a* of the bracket section 88 and the post 87. Upon entry of the trunion 27 into the opening 87*a*, the latch spring 93 is upset releasing the partial bracket section 88 causing counterclockwise rotation of the bracket section 88 about the pivot 89 (in the direction of arrow 89*a*) capturing the trunion 27 within the space or opening 87*a*. The latch spring 93 is adapted to engage a depending portion 94 of the cover plate or piece 95 which serves to form a top for the trunion 27 effectively embracing the trunion 27 within the space 87*a* upon release of the bracket section 88.

In order to uncover the trunion 27 when it is within the opening 87*a*, a load button 96 is placed on the shiftable bracket section 88 allowing it to be depressed into the position shown in FIGS. 9, 10, 11 and 12 so as to permit removal of the trunion 27 and lifting out of the cartridge 15 or cartridge assembly 10 in the reverse procedure from that shown in FIGS. 11–13. It should also be noted, that the rod 90 includes an off-set portion 90*a* which rides on a bracket extension 77*a*. Additionally, the bracket extension 77*a* is biased against the rod 90 and its extension 90*a* by the spring 97, best illustrated in FIGS. 14 and 16. Thus depressing the load button 96 effectively acts to cock the bracket 77 about the pivot 78 biasing the spring 97. When the trunion 27 associated with the cartridge assembly 10 engages the latch spring 93, the bracket section 88 is released and the spring 92 effects rotation of the bracket section 88 about the pivot 89 locking the trunion 27 into the opening 87*a*.

It should be noted therefore that upon release of the latch spring 93 by the striking thereof by the trunion 27 associated with the cartridge assembly 10, and release therefore of the rod 90, spring 92 and rod off-set portion or extension 90*a*, the bracket 77 rotates clockwise about the pivot 78 due to the biasing action of the spring 97, effectively causing rotation of the cartridge assembly 10 in the direction of the arrow 78*a* (FIG. 13) about the pivot 78. This places the cartridge 15 or the cartridge assembly 10 in a home or first position relative to the typing element 72.

After the cartridge 15 or the cartridge assembly 10 has been inserted as described above, and the cartridge assembly 10 tilted to its home or initial position due to release of the rod 90 which allows biasing spring 97 to take over tilting the cartridge assembly 10 forward, the typewriter is ready for operation. The means for shifting the drive mechanism so that the ribbon elevation or lift and the ribbon feed are different depending upon the type of ribbon 12 to be used in the cartridge 15, will be described more completely hereinafter after a more thorough or complete understanding of the ribbon elevation and ribbon feed mechanism.

The selection mechanism for the typewriter is substantially as disclosed in co-pending patent application Ser. No. 756,308 filed on Jan. 3, 1977 and assigned to the assignee of the present invention. Suffice at this point that a print shaft 100 causes rotation through gearing 99 of a second shaft 99*a* to cause rotation of barrel cams 98 which effect both rotation and tilting of the typing element 72 to effect the striking of the element 72 on paper carried by the platen 73. The print shaft 100 is caused to rotate in a conventional manner such as disclosed in U.S. Pat. No. 3,892,304 also assigned to the present assignee and identified heretofore. Suffice that upon the striking of a key representative of a letter or other indicia, the print shaft 100 is caused to rotate.

In the present instance, and in order to effect both lift and feed of the ribbon 12 to place the ribbon 12 intermediate the typing element 72 and the platen 73, and referring now to FIGS. 14 and 15, drive means 100*a*, in the present instance including a gear 101 is mounted on the print shaft 100 and disposed in driving relation to a gear 102 mounted on a shaft 103 which is connected to the carrier 71. The gear ratio between gears 101 and 102 is such that one rotation of the print shaft 100 serves to move the gear 102 1/9th of its total possible rotation. However, it should be understood that the ratio is only by way of example and other ratios may be chosen depending upon the function desired, and in accordance with the teachings set forth herein.

Mounted on the gear 102 is a multiple cam 110 having a plurality of cams or cam tracks thereon designated 111–114 from top to bottom and the layout of which are shown in FIG. 17. As will be more clearly shown hereinafter, cams 111 and 112 are operative to effect feed of the ribbon 12 in the cartridge 15, depending upon the position of an associated cam follower 115, while cams 113 and 114 are coupled through a cam follower 150 to provide lift for the cartridge 15 or the cartridge assembly 10 to conform to one or the other patterns associated with the printing schemes illustrated in FIGS. 3*a* and 3*b*. For illustration purposes, when cam follower 115 is in contact with cam 111, cam follower 150 is in contact with cam 114 to provide the feed and lift respectively for the ribbon print structure illustrated in FIG. 3*a*. Moreover, when cam follower 115 is in contact with cam 112, cam follower 150 is in contact with cam 113 to provide, respectively, for ribbon feed and cartridge lift for the print structure illustrated in FIG. 3*b*. In summary, when cam follower 115 is on cam 111, cam follower 150 will be riding cam 114, and when cam follower 115 is riding cam 112, cam follower 150 will be riding cam 113.

Turning first to the ribbon feed mechanism, when the cam follower 115 is in the position illustrated in FIG. 15, that is riding cam 111, and inasmuch as the ratio between the gearing 101 and 102 is 9:1, it is evident that the cam 111 moves from lobe 1 to lobe 2 (as numbered in FIG. 17 for ease of identification) during one revolution of the print shaft 100, the ribbon feed mechanism being moved wholly upon the cam follower 115 rising up the slope of the lobe. To this end, and as illustrated in FIGS. 15 and 16, the follower 115 is pivotally connected through a link 116 pivoted at 117 and connected to a push rod 118 which in turn is coupled to a ribbon advancing on drive means 120, in the illustrated instance, a spiked ribbon drive 120*b* as by a ratchet lever 119 which cooperates with a face ratchet 119*a* connected to the drive means 120 to effect unitary rotation to the spiked ribbon drive 120*b* as by the tang 119*b* on the lever 119, in the present instance only upon withdrawal or movement of the rod 118 to the left (relative FIG. 16). As best shown in FIGS. 16 and 19, the spiked ribbon drive 120*b* is coupled for rotation to the central portion 79 of the bracket 77 as by shaft 120*a*, the bracket 77 including a lower stabilizer portion 121 which is adapted to underlie a portion of the cartridge 30 and act, in conjunction with the pins 79*a*, 79*b* and the bifurcated legs 80 and 81 to insure good cooperation of the spiked ribbon drive 120*b* with the ribbon advancing surface 20*a* of the roller or take-up spool 20 through the opening 22*a* (see FIG. 4). Thus as the cam follower 115 follows each of the lobes 1 through 9, the spiked ribbon drive 120*b* increments one distance "d" for each revolution of the print shaft 100. As will be more fully explained hereinafter, when the cam follower 115 is lowered to cam 112, while the feed mechanism remains identical, there is only one incremental motion given to the spiked ribbon drive 120*b* for every revolution of the cam 110 and thus only one feed increment of the ribbon 12 for every 9 rotations of the print shaft 100.

As has previously been explained, the mechanism for lifting the ribbon 12 operates off cam 113 or cam 114 depending upon which cam is selected. As illustrated in FIGS. 14, 15 and 17, the cam follower 150 is positioned on a post or the like 151 for vertical movement and for shifting between cam 114 and 113 in a manner which will be explained more fully hereinafter. The follower 150 is connected to a link 152 which is pivoted at 153 to the carrier 71. Link 152 is in turn connected through lift linkage 154 pivoted at 155 and 156 to a yoke 157 having arms 158 and 159 which underlie the guide means 18*a*, 18*b* of the cartridge 15. As the cam follower 150 follows the cam 114 (when cam follower 115 is associated with cam 111) and as may be seen from FIG. 17, the cycle is repeated three times for every revolution of the cam 110, thus providing for the three track levels 1, 2 and 3 shown in FIG. 3*a*. In a like manner, when cam follower 150 follows cam track 113, the lobes are progressively smaller as shown in FIG. 17 allowing for the different track levels (9 in all) as illustrated in FIG. 3*b*.

As heretofore described, the shifting of the mechanism so that cam followers 115 and 150 respectively are either on cams 111 and 114 or 112 and 113 respectively, is preferably controlled automatically by the cartridge 15, depending upon which kind of cartridge 15 is installed in the typewriter. As described heretofore, the type of ribbon 12 contained in the cartridge 15 will depend upon which feed pattern and print pattern is desired, such as that illustrated in FIG. 3*a* or FIG. 3*b*. To this end, the cartridge trunion 27 preferably contains a lobe facing either forward or rearwardly, such as designated F and R in FIGS. 4 and 4*a* respectively. If the cam lobe R is present such as shown in FIG. 4*a*, the feed and lift pattern will be such as illustrated in FIG. 3*a* while if the lobe F is present as shown in FIG. 4, the feed pattern and lift pattern will be as shown in FIG. 3*b*.

The mechanism by which this is accomplished is best illustrated in FIGS. 9, 10, 14 and 15 wherein a cam engaging means, in the illustrated instance a sliding yoke 160 having an opening 161 therein, is mated in sliding engagement with the post 87 and opening 87*a*, the cam engaging means having a depending portion 162 which is pivotally connected to the bracket 86*a* as at 162*a*. The yoke 160 is connected to a lever 163 which is split into a pair of shifting forks 164 and 165 respectively which grasp the cam followers 115 and 150. The shifting forks 164 and 165 are pivoted to the carrier 71 at 166 so that rotation or sliding movement of the yoke 160 about its pivot 162*a*, will effect movement of the shifting forks 164 and 165 about the pivot 166. Thus with the lobe R (FIG. 4*a*) on the cartridge 15, insertion of the cartridge 15 into the holder 75 as heretofore described and the trunion 27 into the bracket 86*a* will cause the mechanism to shift to the left elevating the cam follower 115 and depressing the cam follower 150 about the pivot 166 causing cam follower 115 to engage the upper cam track 111 and the cam follower 150 to engage the lower cam track 114. Alternately, if the lobe F is in place on the cartridge 15, and is inserted into the holder 75 as heretofore described, the cam engaging means 160 will tend to move to the right (FIG. 9) causing the shifting forks 164 and 165 to effect depression of the follower 115 and elevation of the follower 150 so that the follower 115 engages cam track 112 while the follower 150 engages cam track 113.

Erase Function

When an error has been made, it is desirable to elevate the cartridge assembly 10 to a position wherein the ribbon or tape 13 associated with the cartridge 30 lies intermediate the typing element 72 and the platen 73. To this end, mounted on the print shaft 100 is a simple double cam 175 having a tape feed cam track 176 and a tape lift cam track 177. These separate cam tracks 176, 177 are engageable in turn by separate mechanism and followers 178 and 179 respectively, the follower 178 tracking the feed cam track 176 while the follower 179 is adapted but not engageable with the lift cam track 177 until desired. The tape feed cam follower 178 is connected by linkage 180 to a ratchet mechanism illustrated in FIGS. 16 and 19. The ratchet mechanism comprises an indexer 181 which is connected to the link 180 which is engageable for uni-directional motion with spiked driver 182 for feed of the tape 13. As best shown in FIG. 19, the spike driver 182 is also a face ratchet similar to face ratchet 119*a*, and cooperates with a ratchet lever 181*a* having a drive tang 181*b*, the ratchet lever 181*a* being connected to the indexer 181. As shown, both ratchet lever 181*a* and 119 have ratchet drive return springs 181*c* and 119*c* respectively. However despite the fact that follower 178 always follows tape feed cam track 176 on print shaft 100, link 180 is incapable of movement because of the motion inhibiting means 185 which forms part of the erase actuator mechanism 186 associated with the erase function. The mechanism 186 may be formed in any convenient manner but serves to disengage, when energized as by a solenoid or the like 187, the inhibit means 185. Simultaneously, depression of the shift fork arm 186*a* places cam follower 179 into cooperation with the high lift portion of the cam 175 (i.e., the cam track 177) associated with the tape lift function. The follower 179 is connected to a link 188 which in turn is coupled to the link 154 and the yoke 157. Upon energization of the solenoid 187, the downward movement (see the direction of the arrow in FIG. 15) serves to depress through shift fork arm 186*a* the link 188 causing engagement of the follower 179 in the track 177 and serving to override link 152 and increasing the lift on yoke 157 thereby increasing the elevation of the cartridge assembly 10 and effectively causing the erase tape 13 to be positioned intermediate the typing element 72 and the platen 73. At the same time, the motion inhibiting means 185 is removed to permit the follower 178 to follow the cam track 176 and allow the linkage 180, 181 and thus the feed driver 182 to move the tape 13 through the opening 37*a* (FIG. 6).

It should be noted that print occurs during the dwell of ribbon feed and ribbon lift as shown by the two sample lines labelled 201 in FIG. 17. Moreover during the erase function, the feed of the tape 13 occurs one-half before print and one-half after print.

Thus the cartridge of the present invention as well as the mechanism for driving the same presents a new and novel and yet simple but effective way of manipulating and using operator control of a typewriter without the concommittant problems normally associated with operator's having to change tape, shift mechanism by hand, thread ribbon and remove slack therefrom.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. A typewriter cartridge and drive mechanism therefor, said cartridge comprising a case having a body portion and having integral spaced apart guide members projecting therefrom for positioning a preselected portion of a typewriter ribbon in a plane at a predetermined location and distance from said body portion; a first spool mounted for rotation within said body portion, having a fixed axis of rotation and for holding a supply of typewriter ribbon, and a second spool spaced from said first spool for receiving said ribbon; said second spool having an axis which is mounted for motion in a predetermined path within said body portion; means defining an opening along the perimeter of said case and in said path; and means to bias said second spool in said path towards and into said opening and against at least a portion of said means defining said opening; said drive mechanism comprising a ribbon advancing means operatively associated with said opening for providing engagement against said ribbon on said second spool and for moving said second spool away from said means defining said opening; means on said cartridge defining a pivot for said cartridge along an axis thereof essentially parallel to said plane, said cartridge being movable between a first home position and a second elevated position about said axis; first and second cam means, said first cam means operable cyclically to elevate said cartridge from said home position to one of a plurality of print positions, and then to bring said cartridge back to its home position; said second cam means including said ribbon advancing means for effecting advancement of said ribbon upon said cartridge being elevated about said pivot.

2. A typewriter cartridge and drive mechanism therefor in accordance with claim 1 including a bracket mounted for rotational movement about said axis, and means on said bracket to clamp said cartridge.

3. A typewriter cartridge and drive mechanism therefor in accordance with claim 2 wherein said ribbon advancing means is connected to said bracket and moveable therewith.

4. A typewriter cartridge and drive mechanism therefor in accordance with claim 3 wherein said cartridge includes hinge means thereon cooperable with said means on said bracket to effect said clamping.

5. A typewriter cartridge and drive mechanism therefor in accordance with claim 4 wherein said cartridge includes a trunnion thereon and projecting therefrom and acting as said pivot, said trunnion being spaced from said hinges along said axis and cooperating with said hinge means to define said axis essentially parallel to said plane.

6. A typewriter cartridge and drive mechanism therefor in accordance with claim 5 wherein said hinge means comprises a pair of ears having apertures therein and projecting from said cartridge, coacting pin means on said bracket fittable into said apertures so that together they press said ribbon advancing means against said ribbon on said second spool.

7. A typewriter cartridge and drive mechanism therefor in accordance with claim 1 including a cyclically operable print shaft and a printing element operative with rotation thereof; said first cam means and second cam means each including a cam track thereon mounted on a common shaft and rotatable with respect to and with said cyclically operable print shaft; first cam follower means connected to first linkage means for following the movement of said cam track on said first cam means, lift means connected to said first linkage means and in contact with said cartridge for elevating said cartridge.

8. A typewriter cartridge and drive mechanism therefor in accordance with claim 7, including second cam follower means connected to second linkage means for following the movement of said cam track on said second cam means, said second linkage means connected to said ribbon advancing means.

9. A typewriter cartridge and drive mechanism therefor in accordance with claim 8 including at least third and fourth cam tracks, cam follower shift means coupled to said first and second cam follower means, said shift means operable, responsive to a cam on said cartridge, to effect shifting of said first and second cam follower means from said cam tracks on said first and second cam means to said third and fourth cam tracks.

10. A typewriter cartridge and drive mechanism therefor in accordance with claim 9, including a bracket mounted for rotational movement about said axis, and means on said bracket to clamp one end of said cartridge to said ribbon advancing means; and a trunnion projecting from said cartridge and acting as said pivot along said axis and spaced from said bracket.

11. A typewriter cartridge and drive mechanism therefor in accordance with claim 10 wherein said shift means comprises a yoke engageable by said trunnion, said cam on said cartridge being mounted on said trunnion.

12. A typewriter cartridge and drive mechanism therefor in accordance with claim 8, including a bracket mounted for rotational movement about said axis, and means on said bracket to clamp one end of said cartridge to said ribbon advancing means; a trunnion projecting from said cartridge and acting as said pivot along said axis and spaced from said bracket, and separately operable means for limiting the radial movement of said trunnion without inhibiting the rotational movement thereof.

13. A typewriter cartridge and drive mechanism therefor in accordance with claim 12 including means to bias said bracket towards said home position upon installation of a cartridge into said bracket.

14. A typewriter cartridge and drive mechanism therefor in accordance with claim 13 including means coupled to said separately operable means to effect rotation of said bracket and cartridge to said elevated position, and latch means to maintain said bracket in said elevated position to facititate removal of said cartridge.

15. A typewriter cartridge and drive mechanism therefor in accordance with claim 14 wherein said latch means is engageable by said trunnion to effect release thereof whereby said bracket and cartridge rotate to said home position.

16. A typewriter cartridge and drive mechanism therefor in accordance with claim 8 including means defining a separate chamber underlying said case, and a supply spool for holding a supply of erase tape thereon, integral spaced apart guide means for positioning a preselected portion of said erase tape in said plane, but underlying said typewriter ribbon; and selectively operable means to effect elevation of said cartridge about said axis, higher than any print position to a position to align said printing element with said erase tape.

17. A typewriter cartridge and drive mechanism therefor in accordance with claim 16 including separate erase tape advancing means operative by said selectively operable means to advance said erase tape only upon actuation of said selectively operable means.

18. A typewriter cartridge and drive mechanism therefor in accordance with claim 17 including cam means mounted on said print shaft, separate follower means connected to said cam means mounted on said print shaft and linkage means interconnecting said separate follower means to said selectively operable means and erase tape advancing means.

* * * * *